United States Patent [19]

Case et al.

[11] Patent Number: 4,878,507

[45] Date of Patent: Nov. 7, 1989

[54] SMOKING ARTICLES

[75] Inventors: Paul D. Case; David J. Dittrich, both of Southampton, England

[73] Assignee: British-American Tobacco Company, Ltd., London, England

[21] Appl. No.: 239,867

[22] Filed: Sep. 2, 1988

[30] Foreign Application Priority Data

Sep. 3, 1987 [GB] United Kingdom ..... 8720726
Dec. 16, 1987 [GB] United Kingdom ..... 8729389

[51] Int. Cl.[4] ..... A24D 1/00

[52] U.S. Cl. ..... 131/336; 131/364; 131/365; 131/360

[58] Field of Search ..... 131/336, 365, 361, 360, 131/364

[56] References Cited

U.S. PATENT DOCUMENTS

Re. 32,615 3/1988 Luke ..... 131/360
4,624,268 11/1986 Baker et al. ..... 131/365

*Primary Examiner*—Vincent Millin
*Attorney, Agent, or Firm*—Charles G. Lamb

[57] ABSTRACT

Low sidestream cigarettes comprise at least 20% expanded tobacco and cigarette paper of an air permeability of not more than 20 Coresta units, the tobacco density being between 100 and 260 mg $cm^{-3}$.

10 Claims, 2 Drawing Sheets

Figure 1:
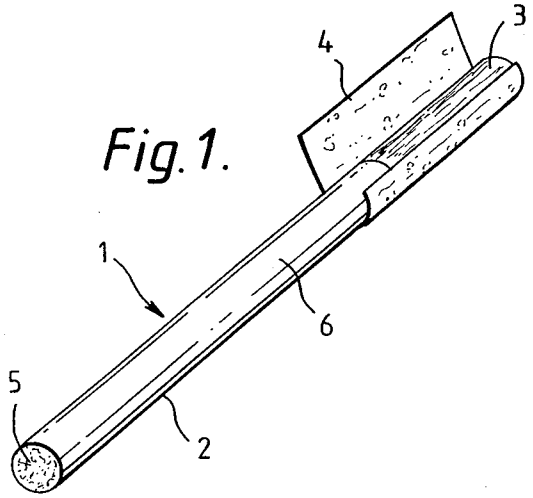

Fig. 3.
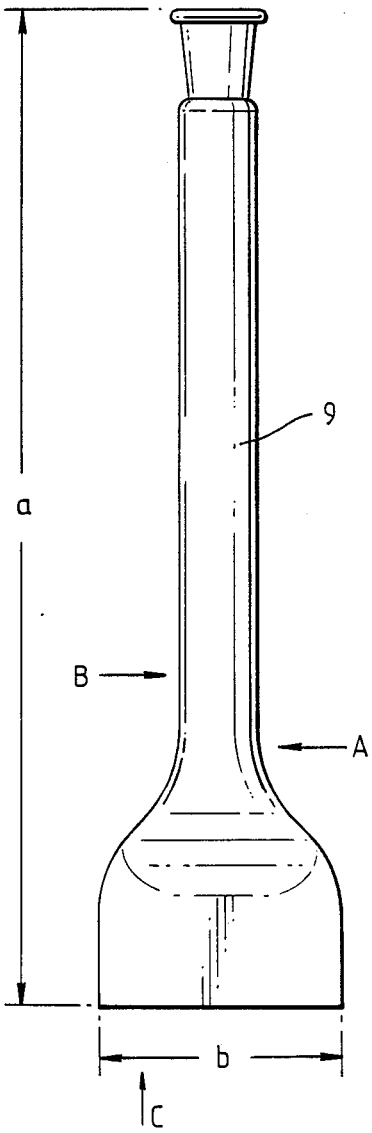
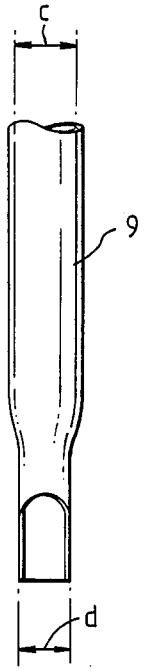
Fig. 4.
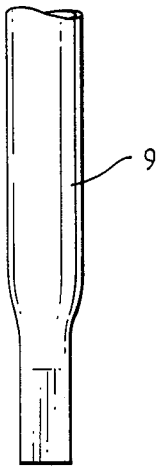
Fig. 5.
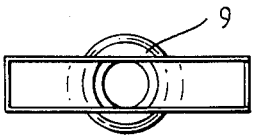
Fig. 6.

SMOKING ARTICLES

The invention the subject of this application relates to cigarettes and similar smoking articles.

A number of approaches have been suggested to the provision of cigarettes which exhibit low deliveries of sidestream smoke components. Thus according to the teaching of United Kingdom Patent Specification No. 2 094 130A cigarettes comprising cigarette papers having air permeabilities due to viscous flow of not more than 3 Coresta units and Do/t ratios of 0.08 to 0.65 cm $sec^{-1}$, where Do signifies thecoefficient of diffusion of oxygen through nitrogen in paper and t signifies the thickness of the cigaarette paper, exhibit low deliveries of total particulate matter, water and nicotine free (PMWNF), and nicotine in the sidestream smoke.

A further approach to the obtainment of low component deliveries in the sidestrem smoke of cigarettes is by way of using cigarette papers comprising one or more sidestream reducing compounds. In United Kingdom Patent Specification No. 2 139 869A there is a disclosure relating to cigarette papers comprising one or more of the compounds of the group consisting of lithium hydroxide, aluminium hydroxide, calcium hydroxide, potassium formate, sodium formate and sodium acetate. The total particulate matter in the sidestream smoke which emanates from cigarettes comprising such papers is reduced by at least 30% compared with a comparable cigarette comprising a conventional cigarette paper. Another example of the use of sidestream reducing compounds is disclosed in U.S. Pat. No. 4,231,377, according to the teaching of which magnesium oxide and an adjuvant salt in combination are incorporated in cigarette papers.

It is an oboject of the subject invention to provide improved low sidestream cigarettes or similar low sidestream smoking articles.

The subject invention provides a smoking article comprising a smoking material rod, which rod comprises smoking material and a paper wrapper circumscribing said smoking material, the density of said smoking material in said rod being in a range of about 100 mg $cm^{-3}$ to about 260 mg $cm^{-3}$, said smoking material comprising at least about 20% by weight of expanded tobacco, the aair permeability of said wrapper being not more than about 20 Coresta units and said smoking article, when smoked under standard machine smoking conditions, providing not less than six puffs and yielding not more than about 17 mg total sidestream PMWNF and not more than about 35 mg total sidestream carbon monoxide.

The air permeability of a paper is expressed din Coresta units as the amount of air, in cubic centimeters, which passes through one square centimeter of the paper in one minute at a constant pressure difference of 1.0 kilopascal.

Inherently porous cigarette paper consists of an interlocking network of fibres, which fibres are usually substantially wholly or mainly cellulose fibres, interspersed with particles of a filler, calcium carbonate for example. Openings in the fibre/filler matrix are of the order of 1 $\mu$m wide, which dimension is small compared with the thickness of the paper (usually 20 to 50 $\mu$m) and the flow of air through such openings is governed by viscous forces. However, when paper is perforated after the paper making process, as by an electrostatic, mechanical or laser process, the perforations are relatively large, usually having width dimensions of the same order of magnitude as the paper thickness, and the flow of air through such perforations is governed by inertial forces.

It is thus to be observed that when the permeability of a perforated paper is determined in accordance with the Coresta permeability determination method, the permeability value obtained will comprise the sum of the permeability due to viscous flow through the openings inherent from the paper making process and the permeability due to inertial flow through the perforations. A paper will also exhibit the same two permeability components if, although not perforated, the paper comprises, in addition to the small, viscous flow holes, larger inertial flow holes, which latter holes may be referred to as pinholes. Paper of this last mentioned construction may result, for example, from a defective paper making technique.

The total air flow through a paper may be expressed as:

$$Q=ZAP+Z'A(P)^n \quad (1)$$

where

Q is the air flow ($cm^3$ $min^{-1}$),

A is the area of paper ($cm^2$) exposed to the flowing air,

P is the pressure difference across the paper (kilopascals),

Z is the permeability of the paper due to viscous flow through the openings inherent from the paper making process in Coresta units (cm $min^{-1}$ $kilopascal^{-1}$), Z' is the permeability of the paper due to inertial flow through perforations and/or pinholes (cm $min^{-1}$ $kilopascal^{-1}$) and n is a constant for a given set of perforation holes or pinholes, where $0.5 \leqq n < 1.0$, the exact value of n depending on the size of the perforations or pinholes.

The total permeability of a paper comprising perforations and/or pinholes is (Z+Z') and the relative values of Z and Z' for a given such paper can be obtained by measuring the flow of air through the paper at a series of pressure differences across the paper and numerically regressing the Q/P data in the above equation using a value of n in accordance with the mean size of the perforations/pinholes in the paper.

It is to be understood that the value of 20 Coresta units recited above in relation to the wrappers of smoking articles according to the subject invention refers to the permeability of the wrappers due to viscous flow. It will thus be appreciated that it is conceivable for a wrapper of a smoking article according to the subject invention to have a total permeability, i.e. the permeability determined using the Coresta permeability determination method, exceeding 20 Coresta units should the wrapper comprise perforations and/or pinholes.

As used herein "standard machine smoking conditions" refers to Coresta standard machine smoking conditions, accordingto which a 35 $cm^3$ puff of two seconds duration is taken every minute.

Smoking articles in accordance with the subject invention should preferably exhibit, when smoked under standard machine smoking conditions, a total yield of sidestream particulate matter on a water and nicotine free basis not exceeding about 15 mg per smoking article and more preferably not exceeding about 10 mg.

Smoking articles in accordance with the subject invention should preferably exhibit, whe smoked under standard machine smoking conditions, a total yield of sidestream carbon monoxide not exceeding about 30 mg, more preferably not exceeding about 20 mg.

In smoking articles according to the present invention smoking material not being expanded tobacco preferably comprises leaf tobacco, suitably in conventional lcut filler form. The leaf tobacco may be lamina and/or stem tobacco. Smoking material not being expanded tobaco may comprise a reconstituted tobacco or a tobacco substitute.

The expanded tobacco may be lamina and/or stem tobacco. The expanded tobacco is advantageously a lamina tobacco the product of a tobacco expansion process which is effective to provide a high degree of expansion in tobacco subjected to the process. High expansion processes are disclosed, for example, in the specification of U.S. Re. Pat. No. 30,693 and in United Kingdom Patent Specifications Nos. 1,570,270 and 2 160 408A. By the use of high expansion processes, tobacco expansion values, in terms of filling value increase, of from about, typically, 75% and even up to about 125% may be obtained. Tobacco which has been subjected to a high expansion process may have a bulk density of, for example, from about 100 mg $cm^{-3}$ to about 175 mg $cm^{-3}$, as measured using a Borgwaldt Densimeter.

The proportion of the smoking material accounted for by expanded tobacco is preferably at least about 30% by weight.

As will be appaarent to skilled-in-the-art addressees, if the expansion of the expanded tobacco is of a low order, it may be required that the proportion of the smoking material accounted for by expanded tobacco approaches, or is at, 100%.

The length of smoking material rods of smoking articles in accordance with the subject invention is preferably not less than 45 mm and is advantageously at least 60 mm. The smoking material rods are preferably of uniform cross-sectional shape and dimensions throughout the lengths thereof. If, as is commonly the case with cigarettes and like smoking articles, a smoking material rod of a smoking article in accordance with the subject invention is of a uniform circular cross-section, the circumference of the rod may be in a range of 10 mm to 30 mm. Whereas significant and commercially useful sidestream smoke reduction advantages arae to be obtained from smoking articles in accordance with the present invention when the rod circumference is 25±5 mm, exceptional such advantages are to be obtained when the rod circumference is below the 25±5 mm range down to 10 mm. Preferably, the rod circumference of smoking articles according to the subject invention is not less than 12.5 mm.

The air permeability due to viscous flow of the paper wrapper of the smoking material rod of smoking articles in accordance with the subject invention is preferably not more than 15 Coresta units and is more preferably not more than 10 Coresta units and yet more preferably not more than about 7 Coresta units.

When smoked under standard machine smoking conditions, smoking articles in accordance with the subject invention advantageously provide not less than seven puffs and more preferably not less than eight puffs.

Preferably, smoking articles in accordance with the subject invention comprise filter or mouthpiece means attached to the smoking material rod at one end thereof.

Smoking articles in accordance with the subject invention may incorporate ventilation means.

It is conceivable that in smoking articles in accordance with the subject invention the paper used for the wrapper could be other than orthodox paper. It might, for example, be reconstituted tobacco sheet material.

In order to further the understanding of the subject invention, examples according thereto will not be described.

Figure 2:
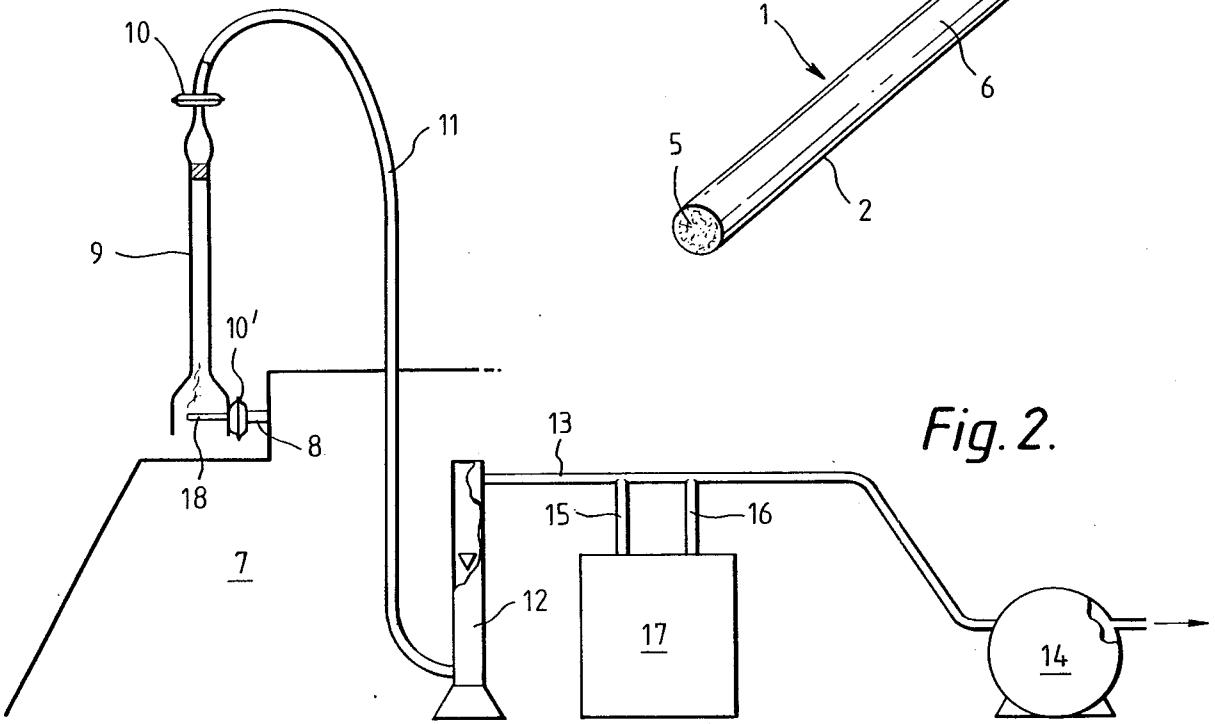

FIG. 1 of the drawings hereof shows a cigarette with a tipping wrappe thereof partially unwrapped;

FIG. 2 shows, diagrammatically, apparatus use din making determination of deliveries of sidestream smoke components and FIGS. 3 to 6 show, diagrammatically, a fishtail chimney forming part of the apparatus shown in FIG. 2, FIGS. 4 to 6 being views on FIG. 3 taken in the directions of aarrows A, B and C respectively.

There was produced a cigarette 1 according to the subject invention consisting of a cigarette rod 2, of a length of 64 mm and a circumference of 24.75 mm, and a 20 mm long cellulose cetate filter 3 attached to the rod 2 by means of a tipping wrapper 4. The rod 2 comprised a cut tobacco filler 5 wrapped in a circumscribing paper wrapper 6. The filler 5 was 100% cut lamina tobacco which had been expanded by use of the high expansion process known as the DIET process. The density of the filler 5 was 174 mg $cm^{-3}$. The wrapper 6 was of an air permeability of less than 1.0 Coresta unit and a substance of 14.8 g $m^{-2}$. The wrapper 6 contained 4.3% of a calcium carbonate filler, but no burn additive.

When cigarettes as per cigarette 1 were smoked under standard machine smoking conditions to a cigarette rod butt length of 8 mm, the average total yields per cigarette of sidestream PMWNF, total nicotine alkaloids (TNA) and carbon monoxide (CO) were 7.2 mg, 0.84 mg and 19.0 mg respectively. The average puff number of these cigarettes was 12.2.

When first comparablel control cigarettes, comprising an unexpanded filler of 100% of the just mentioned cut lamina tobacco wrapped in a conventional cigarette pper of 50 Coresta units air permeability, were smoked according to the just mentioned smoking regime, the average total yields per cigarette of sidestream PMWNF, TNA and CO were 32.0 mg, 5.43 mg and 63.7 mg respectively. The average puff number of the first control cigarettes was 10.0.

When second comparable control cigarettes, comprising as filler 100% expanded cut lamina tobacco as per filler 5 and further comprising conventional cigarette paper as per that of the first control cigarettes, were smoked according to the smoking regime adopted for the cigarettes according to the subject invention, the average total sidestream yields per cigarette of sidestream PMWNF, TNA and CO were 18.2 mg, 2.25 mg and 39.4 mg respectively. The average puff number of the second control cigarette ws 6.0.

When unexpanded cut laminaa tobacco as per that of the first control cigarettes was employed to provide 100% of the filler of third comparable control cigarettes, comprising low permeability rod wrappers of the above mentioned less than 1.0 Coresta unit permeability paper, and the third control cigarettes were smoked, again under standard machine smoking conditions to a butt length of 8 mm, the average total yields per cigarette of sidestream PMWNF, TNA and CO were 19.9 mg, 3.62 mg and 47.8 mg respectively.

It may be readily calculated from the results obtained in smoking the control cigarettes that on a directly linearly proportional basis that expected average total sidestream yields of PMWNF, TNA and CO for comparable cigarettes comprising both a 100% expanded filler, as per filler 5, and a wrapper of the above mentioned less than 1.0 Coresta unit permeability paper, i.e. cigarettes as per cigarette 1, would be 11.3 mg, 1.48 mg and 29.6 mg respectively per cigarette. (The PMWNF value, for example, is calculated as 19.9 (1−0.43)=11.3, 19.9 being the value of PMWNF for the third control cigarettes and 0.43 being the value of PMWNF for the first control cigarettes. minus that for the second control cigarettes expressed as a fraction of that for the first control cigarettes, i.e. the PMWNF reduction ratio.) However, as already mentioned, the measured total sidestream yields of PMWNF, TNA and CO for cigarettes as per cigarette 1 were 7.2 mg, 0.84 and 19.0 mg respectively. It is thus to be observed that the average total sidestream yield of PMWNF for the cigarettes as per cigarette 1, being cigarettes in accordance with the subject invention, was 36% less than the calculated value. It is similarly to be observed that in regard to average total sidestream yields of TNA and CO, the values measured for the cigarettes as per cigarette 1 were 43% and 36% respectively less than the calculaated values. In other words, the cigarettes in accordance with the subject invention exhibited a distinctly synergistic sidestream smoke component reduction effect.

Details are given in Table 1 of average total sidestream component yields and puff numbers for cigarettes in accordance with the subject invention. The cigarettes comprising a wrapper of a paper designated A are those referred to above as being as per cigarette 1. The other cigarettes were comparable except in comprising respectively papers designated B to G. These other cigarettes were smoked in accordance with the smoking regime hereinabove mentioned.

In Table 2 there are presented details of the papers A to G.

In Table 1 the letter 'S' beneath values showon in Columns 5 to 7 denotes a synergistic sidestream smoke component reduction effect. As may be observed of Table 1 synergism in terms of sidestream component reduction is a feature of each of the cigarette constructions embodying wrappers of papers A to G.

TABLE 1

| 1 | 2 | 3 | 4 | 5 | 6 | 7 | 8 |
|---|---|---|---|---|---|---|---|
| | Predicted Sidestream Component Yields - mg cig$^{-1}$ | | | Measured Sidestream Component Yields - mg cig$^{-1}$ | | | |
| Paper | PMWNF | TNA | CO | PMWNF | TNA | CO | Puff No. |
| A | 11.3 | 1.48 | 29.6 | 7.2 S | 0.84 S | 19.0 S | 12.2 |
| B | 13.7 | 1.78 | 36.0 | 10.5 S | 1.36 S | 24.3 S | 9.2 |
| C | 13.1 | 2.05 | 28.5 | 9.7 S | 1.16 S | 21.7 S | 10.2 |
| D | 17.6 | 2.72 | 35.4 | 15.1 S | 1.98 S | 29.3 S | 7.7 |
| E | 12.5 | 2.00 | 29.8 | 10.7 S | 1.45 S | 30.7 | 8.1 |
| F | 9.9 | 1.83 | 26.0 | 8.7 S | 0.89 S | 23.5 S | 10.0 |
| G | 15.7 | 2.74 | 33.7 | 14.4 S | 1.95 S | 32.9 S | 6.9 |

TABLE 2

| Paper Designation | Permeability (C.U.) | Substance (g m$^{-2}$) | Filler (% wt) | Burn Additive (% wt) |
|---|---|---|---|---|
| A | <1.0 | 14.8 | 4.3 $CaCO_3$ | none |
| B | 2.5 | 22.4 | 1.1 $CaCO_3$ 12.9 $TiO_2$ | none |
| C | 3.6 | 17.9 | 9.3 $CaCO_3$ | none |
| D | 5.9 | 19.6 | 22.7 $CaCO_3$ | none |
| E | 2.0 | 22.5 | 5.5 $CaCO_3$ 13.7 $TiO_2$ | 1.8 tri-potassium citrate |
| F | <1.0 | 23.4 | 5.0 $CaCO_3$ 12.1 $TiO_2$ | 1.7 tri-potassium citrate |
| G | 3.5 | 23.0 | 17.4 $CaCO_3$ 1.7 $TiO_2$ | 1.9 di-sodium hydrogen phosphate |

TABLE 3

| 1 | 2 | 3 | 4 | 5 | 6 | 7 | 8 |
|---|---|---|---|---|---|---|---|
| | Predicted Sidestream Component Yields - mg cig$^{-1}$ | | | Measured Sidestream Component Yields - mg cig$^{-1}$ | | | |
| Paper | PMWNF | TNA | CO | PMWNF | TNA | CO | Puff No. |
| A | 14.7 | 1.99 | 35.9 | 9.4 S | 1.50 S | 21.0 S | 13.2 |
| B | 17.8 | 2.39 | 43.6 | 13.1 S | 2.28 S | 29.5 S | 10.9 |
| C | 16.9 | 2.75 | 34.5 | 13.4 S | 2.07 S | 29.4 S | 12.0 |
| E | 16.3 | 2.68 | 36.1 | 14.3 S | 2.19 S | 31.6 S | 9.4 |
| F | 12.9 | 2.45 | 31.5 | 9.6 S | 1.31 S | 24.9 S | 10.1 |
| G | 20.4 | 3.68 | 40.8 | 14.5 S | 3.25 S | 32.3 S | 8.0 |

The cigarettes for which sidestream smoke component values are presented in Table 3 were comparable to the cigarettes the subject of Table 1 excepting that the former cigarettes comprises a filler of 50% expanded tobacco, which expanded tobacco was again DIET expanded tobacco. The remaining 50% of the filler was provided by unexpanded cut lamina tobacco. The density of the filler was 212 mg cm$^{-3}$. The predicted sidestream smoke component values in Table 3 were calculated from measured sidestream delivery values of first, second and third control cigarettes as per detailed above in regard to cigarettes of Table 1. As may be observed from Columns 5 to 7 of Table 3, synergistic sidestream smoke component reduction effects were exhibited by all of the cigarettes the subject of Table 3.

The cigarettes for which sidestream smoke component values are presented in Table 4 were comparable to the cigarettes the subject of Table 1 excepting thata the former cigarettes comprised a filler of 100% cut lamina tobacco which had been expanded by use of a high expansion process as disclosed in United Kingdom Patent Specification No. 2 160 408A. The density of the filler was 140 mg cm$^{-3}$. The predicted sidestream smoke component values in Table 4 were calculated from measured sidestream delivery values of first, second and third control cigarettes in a manner as per detailed above in regard to cigarettes of Table 1. As may be observed from Columns 5 to 7 of Table 4, synergistic sidestream smoke component reduction effects were exhibited by all of the cigarettes the subject of Table 4, with the sole exception of the cigarettes comprising cigarette paper D, for which the sidestream PMWNF delivery ws not synergistic.

TABLE 4

| 1 | 2 | 3 | 4 | 5 | 6 | 7 | 8 |
|---|---|---|---|---|---|---|---|
| | Predicted Side-stream Component Yields - mg cig$^{-1}$ | | | Measured Side-stream Component Yields - mg cig$^{-1}$ | | | |
| Paper | PMWNF | TNA | CO | PMWNF | TNA | CO | Puff No. |
| A | 8.6 | 1.45 | 20.6 | 6.7 S | 0.69 S | 14.7 S | 14.0 |
| B | 10.4 | 1.74 | 25.0 | 9.1 S | 1.09 S | 16.7 S | 9.5 |
| C | 9.8 | 2.0 | 19.8 | 7.7 S | 1.01 S | 15.0 S | 9.3 |
| D | 13.3 | 2.65 | 24.6 | 14.0 | 1.82 S | 21.4 S | 6.0 |
| E | 9.5 | 1.95 | 20.7 | 7.3 S | 1.05 S | 18.4 S | 5.9 |
| F | 7.5 | 1.78 | 18.1 | 6.0 S | 0.80 S | 15.2 S | 8.6 |
| G | 11.8 | 2.68 | 23.4 | 11.0 S | 1.49 S | 20.2 S | 5.0 |

The cigarettes for which sidestream smoke component values are presented in Table 5 were comparable to he cigarettes of Table 1 excepting that the circumference of the former cigarettes was 17.0 mm. The predicted sidestream smoke component values in Table 5 were calculated from measured sidestream delivery values of first, second and third control cigarettes in a manner as per detailed above in regard to cigarettes of Table 1, excepting that in this case the first, second and third control cigarettes were of a 17.0 mm circumference. As may be observed from Columns 5 to 7 of Table 5, synergistic sidestream smoke component reduction effects were exhibited by the cigarettes the subject of Table 5.

The paper H mentioned in Table 5 was of an air permeability of 1.0 Coresta unit and a substance of 22.3 g m$^{-2}$. Paper H comprised 1.3% calcium carbonate and 13.8% titanium dioxide.

TABLE 5

| 1 | 2 | 3 | 4 | 5 | 6 | 7 | 8 |
|---|---|---|---|---|---|---|---|
| | Predicted Side-stream Component Yields - mg cig$^{-1}$ | | | Measured Side-stream Component Yields - mg cig$^{-1}$ | | | |
| Paper | PMWNF | TNA | CO | PMWNF | TNA | CO | Puff No. |
| B | 7.6 | 0.88 | 15.3 | 6.1 S | 0.79 S | 14.0 S | 8.8 |
| H | 7.4 | 0.89 | 15.4 | 7.3 S | 0.62 S | 14.6 S | 10.7 |

The apparatus shown in FIG. 2 which was used in making the determinations of the above cited deliveries of sidestream smoke components comprised a Filtrona 302 linear smoking machine 7, a port of which is designated by reference numeral 8. At each port of the smoking machine 7 there was vertically disposed an open ended, glass fishtail chimney, that associated with port 8 being designated by reference numeral 9. In FIG. 3 dimensions a and b are 410 mm and 80 mm respectively. In FIG. 4 internal dimension (diameter) c is 24 mm and dimension d is 22 mm. Transversely disposed above chimney 9 was a pre-weighed Cambriddge filter pad 10. The item designated by reference numeral 10' is a Cambridge filter pad utilised in the measurement of mainstream smoke component deliveries. A tube 11 extended from the upper side of the filter pad 10 to a gas-flow meter 12, from which meter 12 a tube 13 extended to a gas pump 14. Connected to the pipe 13 by inlet and outlet tubes 15, 16 was an infrared carbon monoxide analyser 17 embodying an internal gas circulation pump (not shown).

In operation of the FIG. 2 apparatus, for the determination of sidestream smoke component deliveries of a cigarette 18 smoked at the port 8 of the smoking machine 7, the pump 14 was set to provide a flow rate through chimney 9, tube 11 nd tube 13 of 2.0 liters per minute. During the smoking of the cigarette 18 under standard smoking conditions at the port 8 the sidestream smoke emanating from the cigarette 18 passed up the chimney 9 to the filter pad 10. That portion of the smoke not deposited at the pad 10 or on the interior walls of the chimney 9 passed through tubes 11, 13 and a sub-sample thereof passed through the carbon monoxide analyser 17 by way of the inlet and outlet tubes 15, 16.

When the smoking at port 8 of the cigarette 18 and two identicla cigarettes has been completed, the pad 10 was are-weighed. From the weight so determined there was subtracted the original weight of the pad 10, thus to give the weight of total particulate matter (TPM) deposited on the pad 10. The pad 10 was then extracted with an extracting solvent, propan-2-ol for example. The extract so obtain was analysed by gas chromatography to determine the amounts of nicotine and water deposited on the pad 10. The sum of the weights so determined of nicotine and water was subtracted from the above mentioned gravimetrically determined weight of TPM deposited on the pad 10, thus to give the weight of PMWNF there deposited.

The interior of the chimney 9 was rinsed with an extracting solvent, propan-2-ol for example. A portion of the extract so obtained was analysed by gas chromatography to determine the amount of nicotine deposited on the interior walls of the chimney 9. The weight of nicotine so determined was added to the weight of nicotine deposited on the pad 10, thus to give the total weight of sidestream nicotine produced from the three cigarettes, which weight was divided by three to give the weight of sidestream nicotine per cigarette.

The other portion of the extract obtained from the rinsing of the chimney 9 was analysed by an ultra violet technique, in which as a standard was employed a portion of the above referred to extract obtained from the pad 10, to determine the amount of PMWNF deposited on the interior walls of the chimney 9. The weight of PMWNF so determined was added to the weight of PMWNF, as above determined, deposited on the pad 10, thus to give the total weight of sidestream PMWNF produced from the three cigarettes, which weight was divided by three to give the weight of sidestream PMWNF per cigarette.

The sidestream smoke CO yield per cigarette was determined from data obtained from the analyser 17.

We claim:

1. A smoking article comprising a smoking material rod, which rod comprises smoking material and paper wrapper circumscribing said smoking material, the density of said smoking material in said rod being in a range of about 100 mg cm$^{-3}$ to about 260 mg cm$^{-3}$, said smoking material comprising at least about 20% by weight of expanded tobacco, the air permeability of said wrapper being not more than about 20 Coresta units and said smoking article, when smoked under standard machine smoking conditions exhibiting a synergistic sidestream smoke component reduction effect, and providing not less than six puffs and yielding not more than about 17 mg total sidestream PMWNF and not more than about 35 mg total sidestream carbon monoxide.

2. A smoking article as claimed in claim 1, wherein the air permeability of said wrapper is not more than 15 Coresta units.

3. A smoking article as claimed in claim 2, wherein the air permeability of said wrapper is not more than 10 Coresta units.

4. A smoking article as claimed in claim 3, wherein the air permeability of said wrapper is not more than 7 Coresta units.

5. A smoking article as claimed in any one of the preceding claims, wherein the circumference of said smoking material rod is within a range of 20 mm to 30 mm.

6. A smoking article as claimed in any one of claims 1 to 4, wherein the circumference of said smoking material rod is within a range of 10 mm to 20 mm.

7. A smoking article as claimed in claim 6, wherein the circumference of said rod is within a range of 12.5 mm to 20 mm.

8. A smoking article as claimed in claim 1, wherein said smoking material comprises at least 30% by weight expanded tobacco.

9. A smoking article as claimed in claim 1, wherein said expanded tobacco is tobacco which has been expanded so as to provide an increase in filling value of at least 75%.

10. A smoking article as claimed in claim 1, wherein said expanded tobacco has a bulk density in a range of 100 mg $cm^{-3}$ to 175 mg $cm^{-3}$.

* * * * *